US010413467B2

(12) United States Patent
Tiffin et al.

(10) Patent No.: US 10,413,467 B2
(45) **Date of Patent: *Sep. 17, 2019**

(54) ELECTRICALLY-POWERED PLATFORM POOL LIFT

(71) Applicant: Everlast Climbing Industries, Inc., Mendota Heights, MN (US)

(72) Inventors: Ben Tiffin, Missoula, MT (US); Shane Clagett, Missoula, MT (US); Timothy Sudeith, Edina, MN (US)

(73) Assignee: EVERLAST CLIMBING INDUSTRIES, INC., Mendota Heights, MN (US)

( * ) Notice: Subject to any disclaimer, the term of this patent is extended or adjusted under 35 U.S.C. 154(b) by 99 days.

This patent is subject to a terminal disclaimer.

(21) Appl. No.: 15/290,194

(22) Filed: Oct. 11, 2016

(65) Prior Publication Data

US 2017/0027793 A1 Feb. 2, 2017

Related U.S. Application Data

(63) Continuation of application No. 14/231,152, filed on Mar. 31, 2014, now Pat. No. 9,486,376.

(51) Int. Cl.
*A61G 7/10* (2006.01)
*A61G 3/06* (2006.01)

(52) U.S. Cl.
CPC ..... *A61G 7/1005* (2013.01); *A61G 7/1019* (2013.01); *A61G 3/063* (2013.01);
(Continued)

(58) Field of Classification Search
CPC ..... A61G 7/1001–1019; A61G 7/1063; A61G 7/1065; E04H 4/06; E04H 4/065
See application file for complete search history.

(56) References Cited

U.S. PATENT DOCUMENTS 2,482,211 A 2/1947 Reichardt
2,624,053 A * 1/1953 Beckwith ..... A61G 7/1003 4/565.1

(Continued)

OTHER PUBLICATIONS

International Preliminary Report and the Written Opinion of the International Searching Authority for PCT Application No. PCT/US2015/023496 dated Oct. 13, 2016, 11 pages.

(Continued)

*Primary Examiner* — Erin Deery
*Assistant Examiner* — Nicholas A Ros
(74) *Attorney, Agent, or Firm* — McAndrews, Held & Malloy, Ltd.

(57) ABSTRACT

Various embodiments include a system that provides assisted access to a pool. The system includes a platform that includes a frame, a deck, and one or more handrails. The deck is attached to the frame and sized to receive a wheelchair. The one or more handrails are attached to at least one of the frame and the deck. The system includes an upright lifting component case. The frame of the platform is substantially perpendicular to the upright lifting component case. The system includes lifting components that are at least partially disposed in the upright lifting component case and attached to the platform. The lifting components are operable to vertically move the frame between a top and a bottom of the upright lifting component case. The system includes an electrical power source operable to provide electrical power to at least a portion of the lifting components.

21 Claims, 11 Drawing Sheets

(52) U.S. Cl.
CPC ..... *A61G 2200/34* (2013.01); *A61G 2203/12* (2013.01); *A61G 2203/40* (2013.01)

(56) References Cited

U.S. PATENT DOCUMENTS 3,078,475 A * 2/1963 Turner ..... A61G 7/1003 4/562.1
3,661,228 A 5/1972 Glasser
3,946,788 A 3/1976 Van Muyen
4,133,437 A 1/1979 Gates
4,141,089 A 2/1979 Krumbeck
4,283,803 A * 8/1981 Krumbeck ..... A61G 7/1044 4/254
4,353,436 A * 10/1982 Rice ..... A61G 3/062 187/200
4,399,570 A * 8/1983 Tracy ..... A61G 7/1005 114/362
4,599,835 A 7/1986 Rinke
4,624,019 A * 11/1986 Pennington-Richards ..... A61G 7/1003 4/566.1
4,712,788 A * 12/1987 Gaudreau, Jr. ..... A63B 22/02 4/496
4,937,896 A * 7/1990 Niimura ..... E04H 4/065 4/495
5,143,181 A 9/1992 Bixby
5,158,157 A * 10/1992 Billington, III ..... B66F 11/04 182/113
5,322,408 A 6/1994 Wooden
5,367,727 A * 11/1994 Dyer, Jr. ..... A47C 27/085 5/678
5,368,131 A 11/1994 Yoshihiro
5,499,694 A 3/1996 Dorn
5,542,493 A 8/1996 Jacobson et al.
5,702,222 A * 12/1997 Rosen ..... B66F 7/025 187/214
5,883,680 A * 3/1999 Nykerk ..... H01H 9/0235 340/12.22
5,901,812 A * 5/1999 Meunier ..... B66B 9/0853 187/200
5,901,816 A 5/1999 Camilleri
6,086,314 A * 7/2000 Savaria ..... A61G 3/06 414/546
7,562,403 B2 * 7/2009 Wei ..... A61G 7/1015 5/81.1 R
7,926,618 B2 * 4/2011 Zuercher ..... B60P 1/4471 187/200
9,486,376 B2 * 11/2016 Tiffin ..... A61G 7/1005
2007/0079439 A1 4/2007 Patterson et al.
2007/0137944 A1 * 6/2007 Lam ..... A61G 3/063 187/267
2007/0158627 A1 * 7/2007 Dittmer ..... F16M 11/18 254/124
2010/0122406 A1 5/2010 Gschwind
2013/0098712 A1 * 4/2013 Svendsen ..... A61G 7/1005 187/381
2013/0312174 A1 * 11/2013 Kanetis ..... A61G 7/1005 4/496
2014/0041119 A1 * 2/2014 Thodupunuri ..... A61G 7/08 5/510

OTHER PUBLICATIONS

International Search Report and the Written Opinion of the International Searching Authority for PCT Application No. PCT/US2015/023496 dated Jul. 2, 2015, 16 pages.

* cited by examiner

ELECTRICALLY-POWERED PLATFORM POOL LIFT

CROSS-REFERENCE TO RELATED APPLICATIONS/INCORPORATION BY REFERENCE

The present application is a continuation of U.S. patent application Ser. No. 14/231,152, entitled "Electrically-Powered Platform Pool Lift," filed Mar. 31, 2014. The entire contents of the above-mentioned prior-filed application are hereby expressly incorporated herein by reference.

FIELD OF THE INVENTION

Certain embodiments of the invention relate to assisted pool access devices. More specifically, certain embodiments of the invention relate to an electrically-powered platform lift mountable in a pool.

BACKGROUND OF THE INVENTION

Title III of the ADA prohibits discrimination on the basis of disability by places of public accommodation. The 2010 Standards require that newly constructed or altered swimming pools, wading pools, and spas have an accessible way for people with disabilities to enter and exit the pool. Examples of accessible means for entering and exiting a pool include sloped entries and pool lifts.

With regard to sloped entries, most facilities simply do not have enough space to incorporate a sloped entry into new construction, and the cost to add a sloped entry to an existing pool is not feasible. Although pool lifts can be more space and cost effective than sloped entries, existing pool lifts have a number of drawbacks. For example, existing pool lifts are typically deck mounted, which may clutter the pool deck. As another example, existing pool lifts are typically chair-based devices that require an individual in a wheelchair to transfer from the wheelchair to the lift chair prior to entering the pool. Existing pool lifts that are mounted in a pool and have a platform for lowering a wheelchair into the pool are currently hydraulically-powered. Existing hydraulically-powered pool lifts are larger and less powerful (i.e., lower weight capacity) than electrically-powered pool lifts.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A system and/or method is provided for an electrically-powered platform lift that provides assisted access to a pool, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Figure 1:
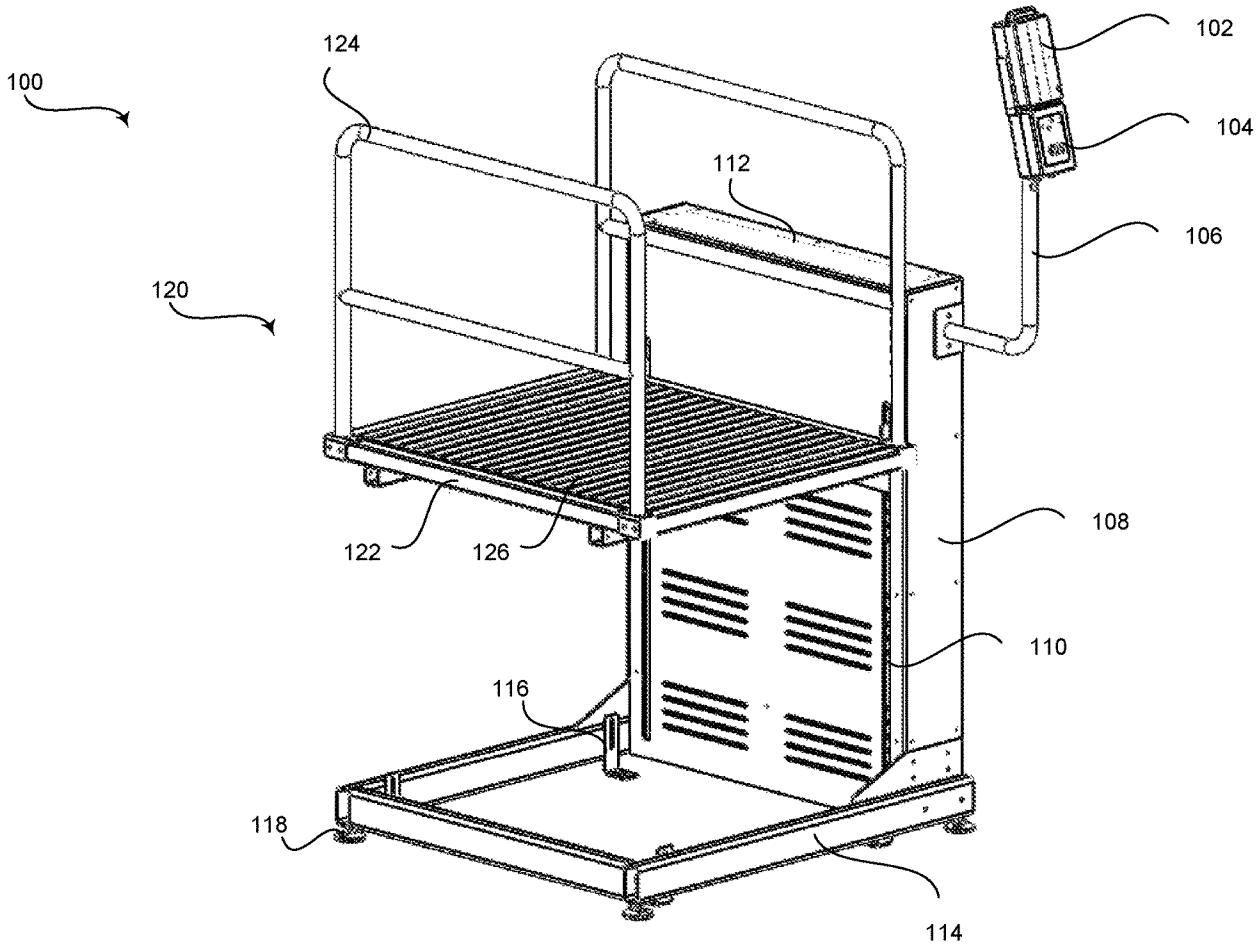
FIG. 1 is a front perspective view of an exemplary platform lift with the platform in an elevated position, in accordance with an embodiment of the invention.

Certain embodiments of the invention may be found in a pool lift. More specifically, certain embodiments provide an electrically-powered platform lift mountable in a pool. An example embodiment of the present invention aids users with limited mobility by providing a pool lift that can transfer a wheelchair holding the user into a pool, instead of having to transfer the limited mobility user from the wheelchair into the lift chair, and then into the pool, for example. An example embodiment of the present invention provides a clean finish to a swimming pool deck by mounting the pool lift directly in the pool.

Various embodiments include a system 100 that provides assisted access to a pool. The system 100 comprises a platform 120 that comprises a frame 122, a deck 126, and one or more handrails 124. The deck 126 is attached to the frame 122 and sized to receive a wheelchair. The one or more handrails 124 are attached to at least one of the frame 122 and the deck 126. The system 100 comprises an upright lifting component case 108. The frame 122 of the platform 120 is substantially perpendicular to the upright lifting component case 108. The system 100 comprises lifting components (e.g., 134, 138, 140, 142, 144, 146, 150, 156) that are at least partially disposed in the upright lifting component case 108 and attached to the platform 120. The lifting components (e.g., 134, 138, 140, 142, 144, 146, 150, 156) are operable to vertically move the frame 122 between a top and a bottom of the upright lifting component case 108. The system 100 comprises an electrical power source 102 operable to provide electrical power to at least a portion of the lifting components (e.g., 134).

As used herein, the terms "exemplary" or "example" means serving as a non-limiting example, instance, or illustration. As used herein, the term "e.g." introduces a list of one or more non-limiting examples, instances, or illustrations.

As used herein, an element recited in the singular and proceeded with the word "a" or "an" should be understood as not excluding plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

FIG. 1 is a front perspective view of an exemplary platform lift 100 with the platform 120 in an elevated position, in accordance with an embodiment of the invention. Referring to FIG. 1, the platform lift 100 comprises an electrical power source 102, a control console 104, a lifting component case 108, a lifting frame 114, and a platform 120. The electrical power source 102 may be a battery or any suitable power source that provides power to the control console 104 and lifting components disposed in the lifting component case 108. For example, the electrical power source 102 can be a 24 volts direct current (VDC) rechargeable battery.

Figure 11:
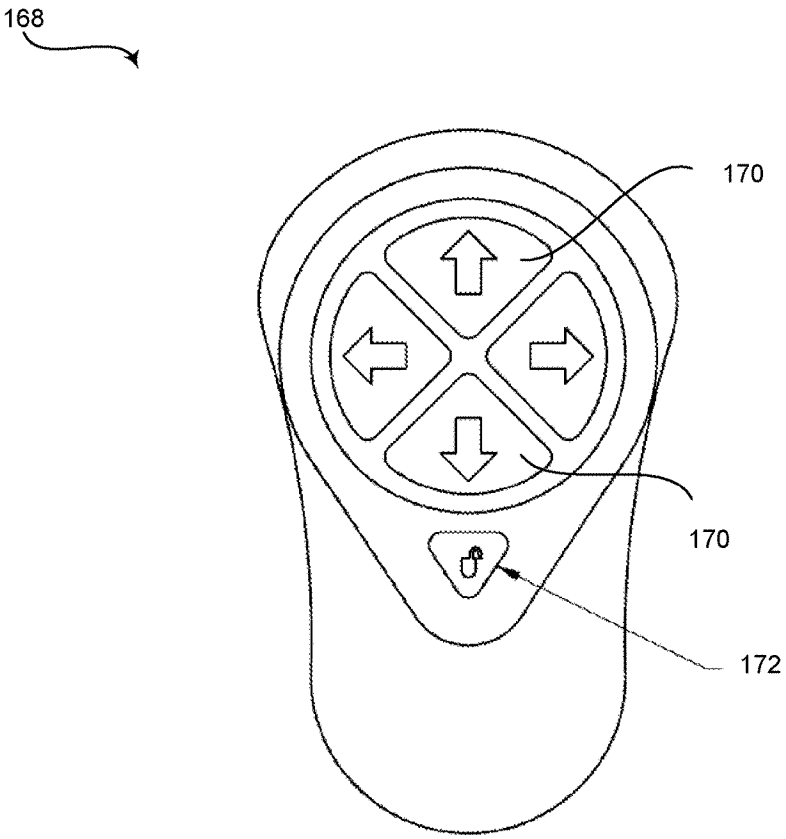
FIG. 11 is front perspective view of an exemplary wireless handset configured to operate a platform lift, in accordance with an embodiment of the invention.

The control console 104 provides control of the operation of the platform lift 100. The control console 104 includes control buttons for providing directional control of the platform 120. In various embodiments, the control console 104 can include a radio frequency control receiver powered by the electrical power source 102 for wirelessly communicating with one or more wireless handsets that allow remote operation of the platform lift 100, such as by a user situated on the platform 120. FIG. 11 is front perspective view of an exemplary wireless handset 168 configured to operate a platform lift 120, in accordance with an embodiment of the invention. Referring to FIG. 11, the wireless handsets 168 are operable by either a left or right hand and are sealed to prevent water damage. The wireless handsets 168 can be, for example, detachably coupled to rails 124 of the platform 120 and, similar to the control console 104, include control buttons 170 operable to control the vertical travel of the platform 120. In certain embodiments, a pressure for depressing a control button 170 of the control console 104 and/or wireless handset(s) 168 is less than or equal to 2 pound force (lbf). In various embodiments, the wireless handset(s) 168 can include a lockout button 172 for preventing accidental activation of the platform lift 100. For example, pressing and holding the lockout button 172 for 2 seconds, or any suitable time period, can wake the wireless handset(s) 168 from a sleep mode, and if the wireless handset(s) 168 is not used for 2 minutes, or any suitable time period, the handset(s) 168 may go back into the sleep mode.

Referring again to FIG. 1, the lifting component case 108 houses the components operable to lift the platform 120. The lifting component case 108 can be fiberglass or any suitable material. In various embodiments, the lifting component case 108 may be coated with a corrosion resistant barrier. The lifting component case 108 can be coupled to the control console 104 and electrical power source 102 by a mount pole 106. Additionally and/or alternatively, the control console 104 and/or electrical power source 102 may be mounted on or disposed within the lifting component case 108. The lifting component case 108 comprises case slots 110 such that lifting components disposed within the lifting component case 108 can couple with and vertically move the platform between a top and bottom of the lifting component case 108 as defined by the case slots 110. The lifting component case includes a case top 112. In various embodiments, the case top 112 or any suitable end or side of the lifting component case 108 may be removable to, for example, access, clean, service, and/or repair the components disposed within the lifting component case 108.

The lifting frame 114 mounts to a pool floor and couples to the lifting component case 108 to support the platform lift 100. The lifting frame 114 attaches to the lifting component case 108 to hold the lifting component case 108 in an upright (i.e., vertical) position. The lifting frame 114 comprises floor brackets 116 and leveling pads 118. The floor brackets 116 are operable to affix the lifting frame 114 to the pool floor. The leveling pads 118 are adjustable pads on an underside of the lifting frame 114 for assisting with leveling the platform 120 with the pool deck when the platform 120 is in an elevated position and/or with the pool floor when the platform 120 is in a lowered position.

The platform 120 comprises a frame 122, rails 124, and a deck 126. The frame 122 attaches to the lifting components disposed in the lifting component case 108 through case slots 110, such that the lifting components may raise and lower the platform 120. The rails 124 attach to two opposing sides of the frame 122 to provide a hand grip for a user of the platform lift 100. The deck 126 affixes to a top side of the frame 122 to provide a surface for receiving the wheelchair being elevated and/or lowered using the platform lift 100. In various embodiments, the deck 126 can be approximately 40 inches by 46 inches or any suitable dimensions. The deck 126 can be fiberglass or any suitable material, and may include a non-slip textured surface. The rails 124 may be approximately 34 inches tall and can be positioned on each 46 inch side of the deck 126, for example. The frame 122 and rails 124 can be stainless steel or any suitable material.

Figure 2:
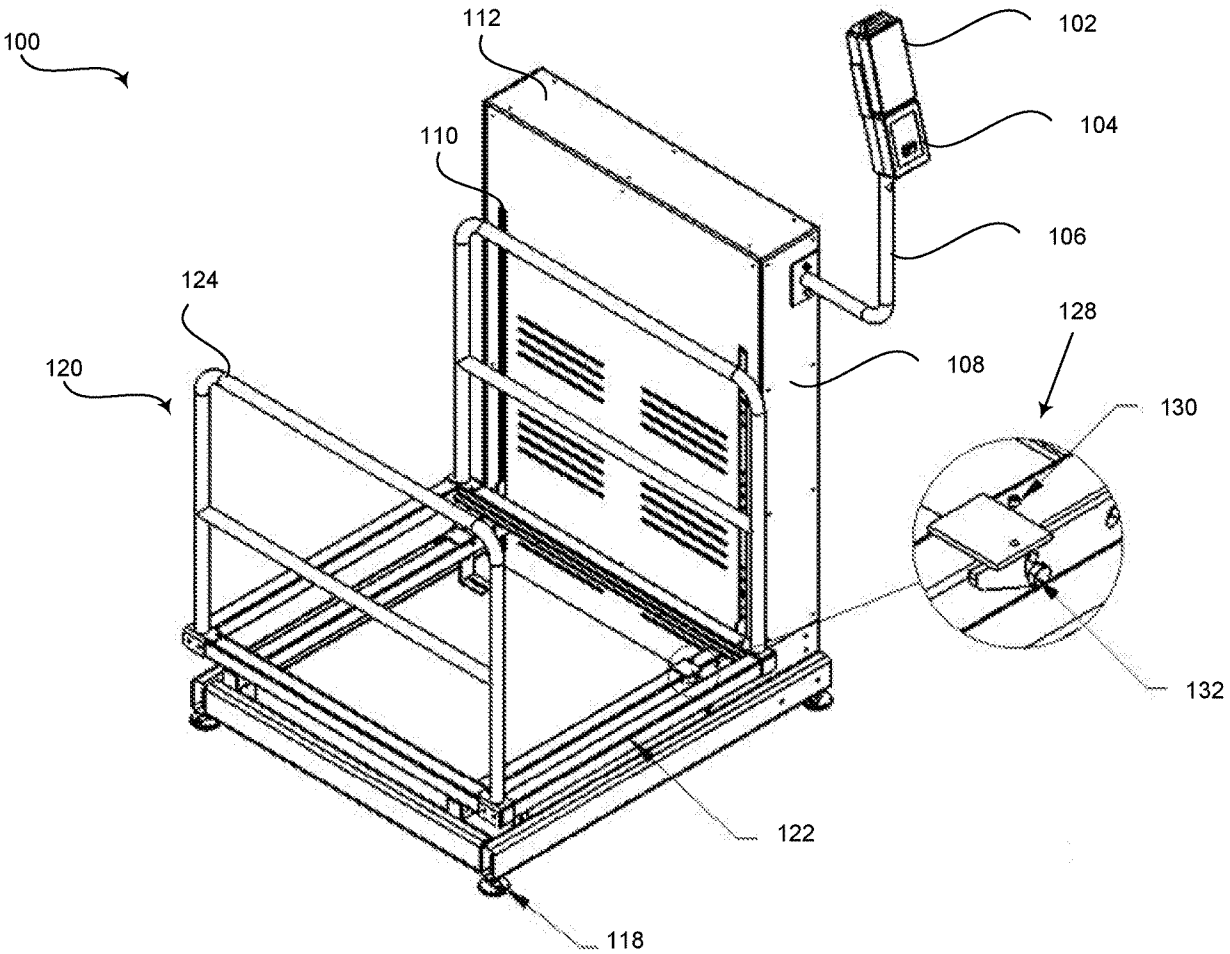
FIG. 2 is a partially exploded view of a platform adjustment mechanism of a platform frame of an exemplary platform lift, in accordance with an embodiment of the invention.

FIG. 2 is a partially exploded view of a platform adjustment mechanism 128 of a platform frame 122 of an exemplary platform lift 100, in accordance with an embodiment of the invention. Referring to FIG. 2, the platform frame 122 comprises a platform adjustment mechanism 128. For example, the angle of the platform deck 126 can be adjusted to align with the pool deck so that a user in a wheelchair can easily move between the pool deck and the platform deck 126. The platform adjustment mechanism 128 comprises one or more locking screws 132 and one or more angle adjustment screws 130. The angle of the platform deck 126 is adjusted by loosening the locking screw(s) 132 and tightening or loosening the platform angle adjustment screw(s) 130 to adjust the angle of the platform deck 126. After the desired angle is achieved, the locking screw(s) 132 are tightened to lock the platform deck 126 in place. In various embodiments, if the desired angle cannot be achieved using the platform adjustment mechanism 128, the leveling pads 118 of the lifting frame 114 may be adjusted to assist in obtaining the desired angle.

Figure 3:
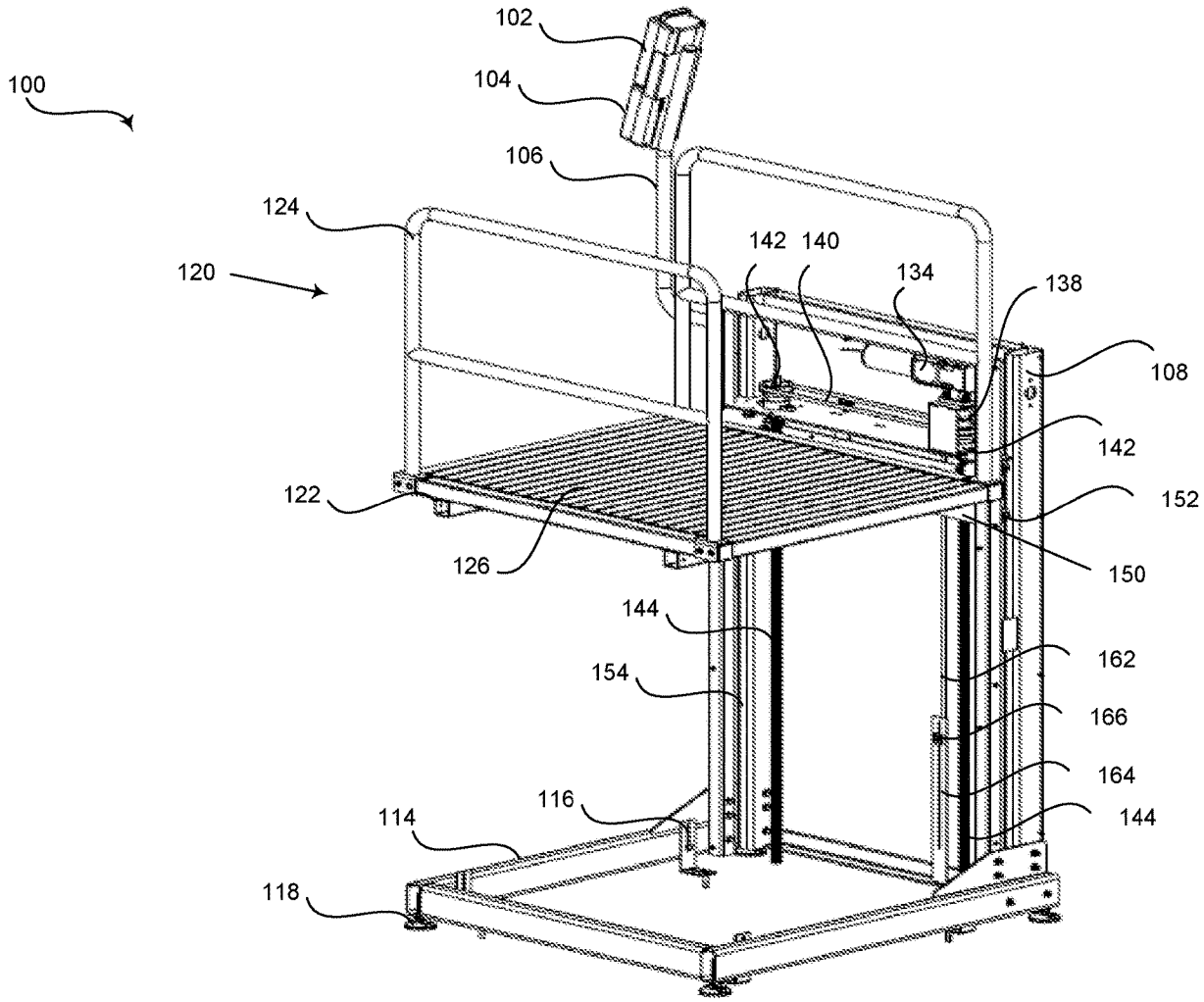
FIG. 3 is a front perspective view of an exemplary platform lift without a portion of the lifting component case and with the platform in an elevated position, in accordance with an embodiment of the invention.
Figure 4:
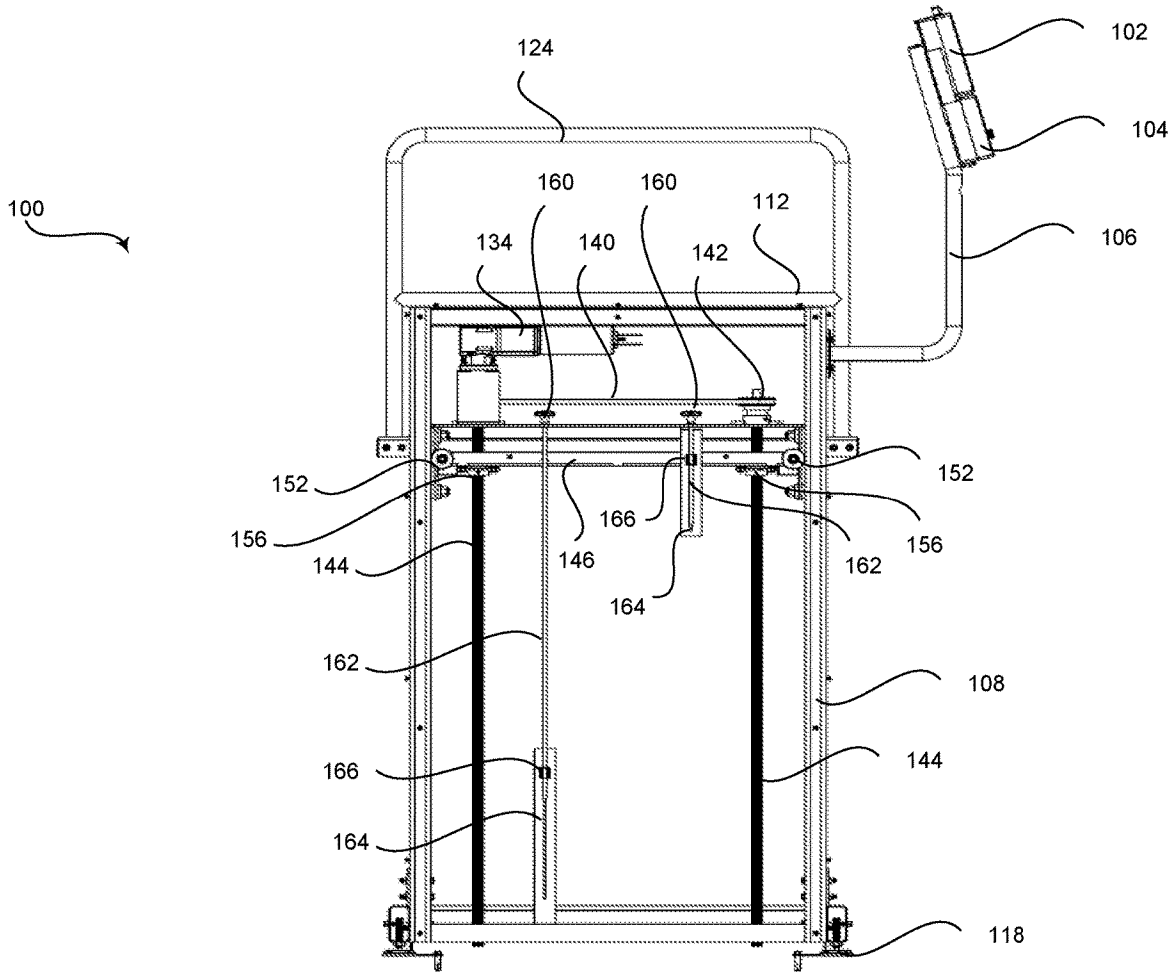
FIG. 4 is a rear elevation view of an exemplary platform lift without a portion of the lifting component case and with the platform in an elevated position, in accordance with an embodiment of the invention.
Figure 5:
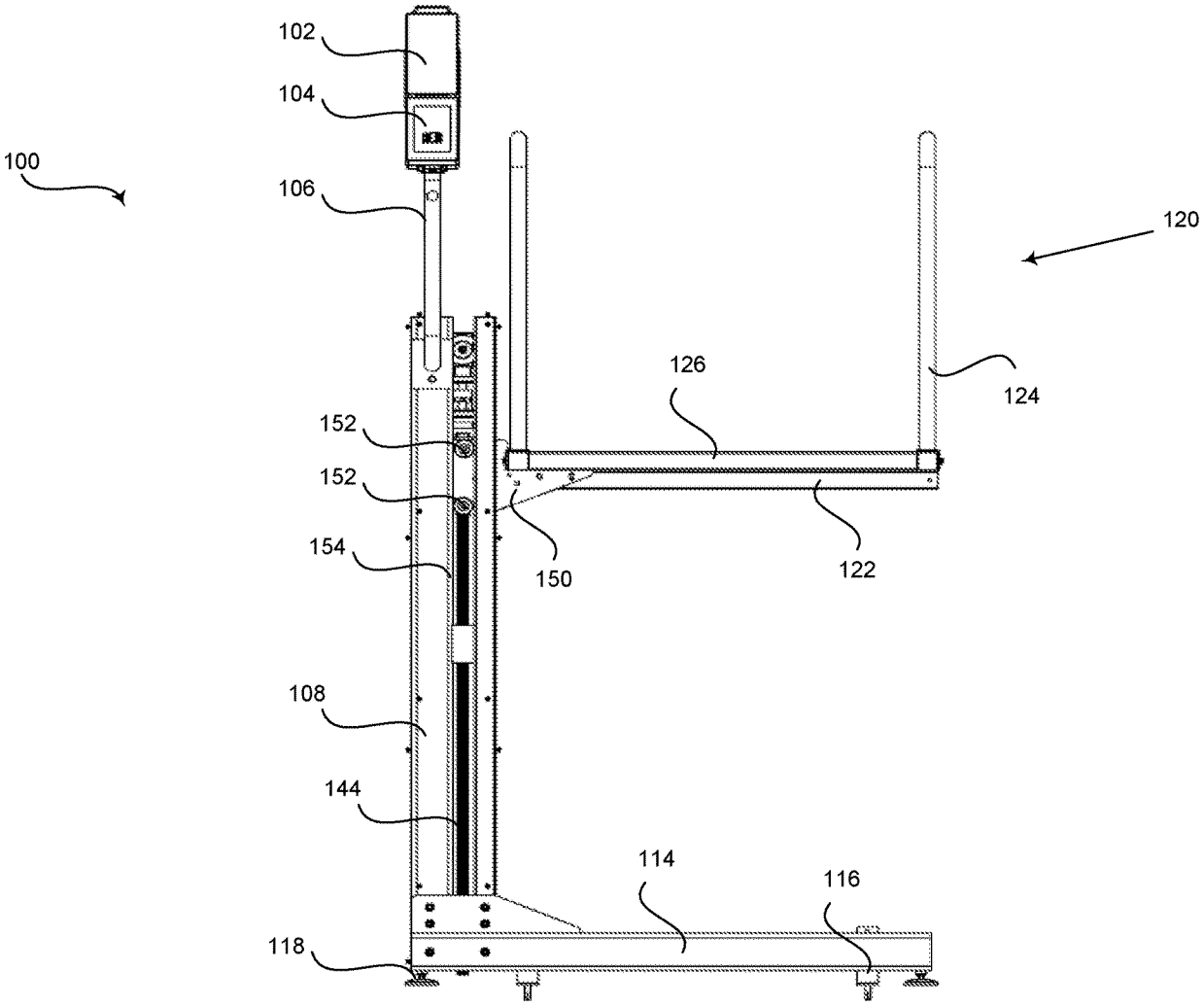
FIG. 5 is a side elevation view of an exemplary platform lift without a portion of the lifting component case and with the platform in an elevated position, in accordance with an embodiment of the invention.

FIG. 3 is a front perspective view of an exemplary platform lift 100 without a portion of the lifting component case 108 and with the platform 120 in an elevated position, in accordance with an embodiment of the invention. FIG. 4 is a rear elevation view of an exemplary platform lift 100 without a portion of the lifting component case 108 and with the platform 120 in an elevated position, in accordance with an embodiment of the invention. FIG. 5 is a side elevation view of an exemplary platform lift 100 without a portion of the lifting component case 108 and with the platform 120 in an elevated position, in accordance with an embodiment of the invention. Referring to FIGS. 3-5, the platform lift 100 comprises an electrical power source 102, a control console 104, a lifting component case 108, a lifting frame 114, and a platform 120. The platform 120 comprises a frame 122, rails 124, and a deck 126 as described above in connection with FIGS. 1-2. The lifting frame 114 comprises floor brackets 116 and leveling pads 118. The lifting frame 114 mounts to a pool floor and couples to the lifting component case 108 to hold the lifting component case 108 in an upright (i.e., vertical) position as described above in connection with FIG. 1.

The electrical power source 102 provides power to the control console 104 and lifting components disposed in the lifting component case 108. The control console 104 provides control of the operation of the platform lift 100. The lifting component case 108 houses the components operable to lift the platform 120. In various embodiments, the components operable to lift the platform 120 comprise an electric motor 134, a shaft coupler 138, a belt 140, sprockets 142, power screws 144, a carriage plate 146, and power screw receiving mechanisms 156.

The electric motor 134 is powered by the electrical power source 102 and controlled by the control console 104. The electrical motor 134 operates to rotate power screws 144 in a first direction to elevate the platform 120 and in a second direction to lower the platform 120 as directed by control signals received from the control console 104. More specifically, the electrical motor 134 may be activated to create rotational energy of a motor shaft in a clockwise or counterclockwise direction. The motor shaft may be attached to a shaft of a sprocket 142 via a shaft coupler 138, such as a jaw coupling, for example. The shaft coupler 138 transmits the torque generated by the motor 134 to the sprocket 142. The sprocket 142 is attached to a power screw 144 and a belt 140. As the sprocket 142 is rotated by the motor 134, the sprocket rotates the power screw 144 and the belt 140. The belt 140 can be a carbon fiber belt or any suitable belt that is stretched between a pair of sprockets 142. As the first sprocket 142 coupled to the electric motor 134 is rotated by the electric motor 134, the belt 140 is driven to rotate a second sprocket 142 that is attached to and rotates a second power screw 144. As such, the power screws 144 are simultaneously rotated in a same direction to cooperate in elevating and lowering the platform 120.

Figure 7:
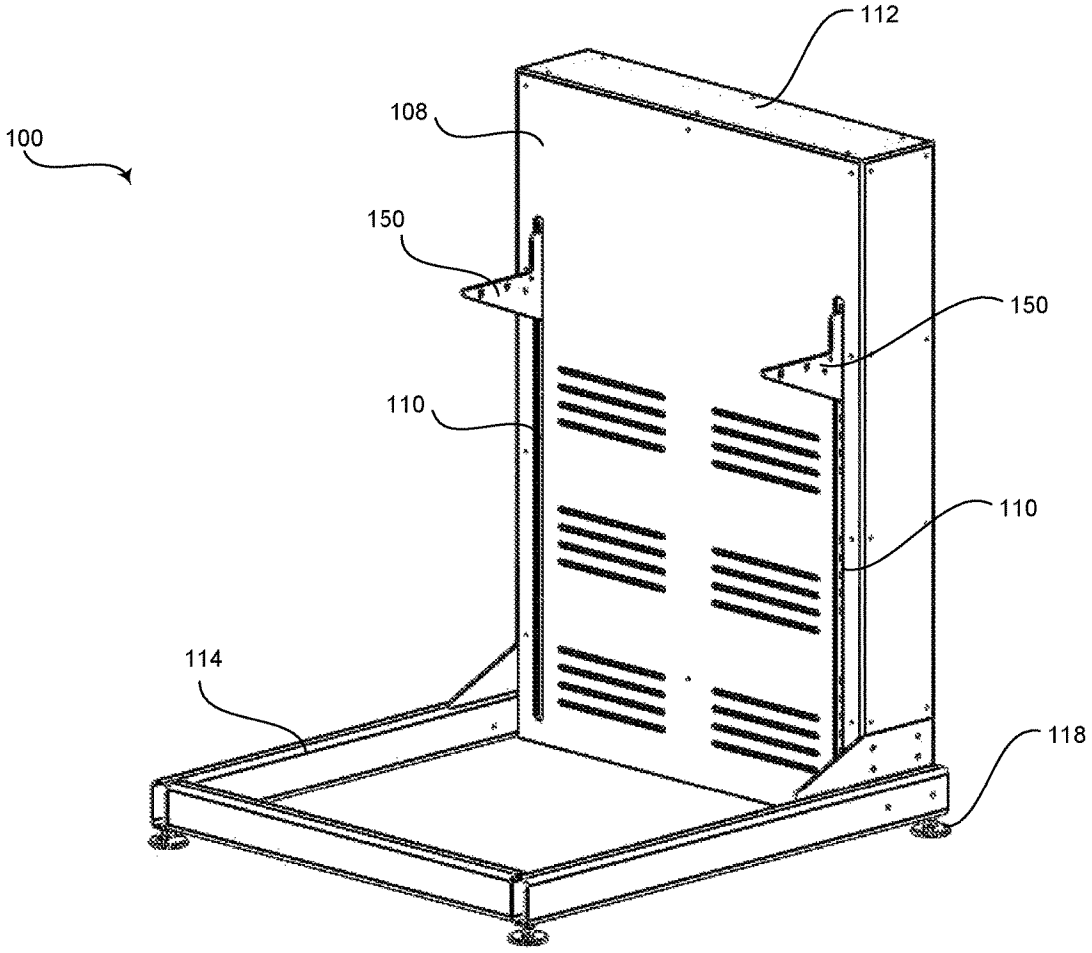
FIG. 7 is a front perspective view of an exemplary platform lift without the platform, in accordance with an embodiment of the invention.

The power screws 144 are coupled to the platform 120 by a carriage plate 146 that extends substantially the width within the lifting component case 108. The carriage plate 146 comprises power screw receiving mechanisms 156, plate apertures 148, and carriage connector brackets 150. As described in more detail below in connection with FIG. 8, the power screws 144 extend through the plate apertures 148 and are coupled to the carriage plate 146 at the power screw receiving mechanisms 156. As the power screws 144 rotate, the carriage plate 146 is elevated or lowered based on the rotational direction of the power screws 144. The carriage connector brackets 150 extend from the ends of the carriage plate 146 through the case slots 110 of the lifting component case 108. FIG. 7 is a front perspective view of an exemplary platform lift 100 without the platform 120, in accordance with an embodiment of the invention. Referring to FIG. 7, the carriage connector brackets 150 are shown extending through the case slots 110 of the lifting component case 108. Referring again to FIGS. 3-5, the carriage connector brackets 150 attach to the lifting frame 122 of the platform 120 such that the platform 120 extends substantially perpendicularly from the lifting component case 108 and is vertically movable between a top and bottom of the lifting component case 108 as defined by the case slots 110 and the stop adjustment electronic switches 166, as discussed in more detail below.

In various embodiments, carriage wheels 152 may be coupled to each of the carriage connector brackets 150 and slidably fit within wheel guide slots 154 that extend vertically along the ends of the lifting component case. The carriage wheels 152 may be polymer plane bearings and stainless steel rollers, or any suitable material. The carriage wheels 152 slidably coupled within the wheel guide slots 154 assist in distributing the loads evenly and safely, provide additional support to maintain a level angle of the platform 120, and assist with providing smooth vertical movements of the platform 120.

Figure 6:
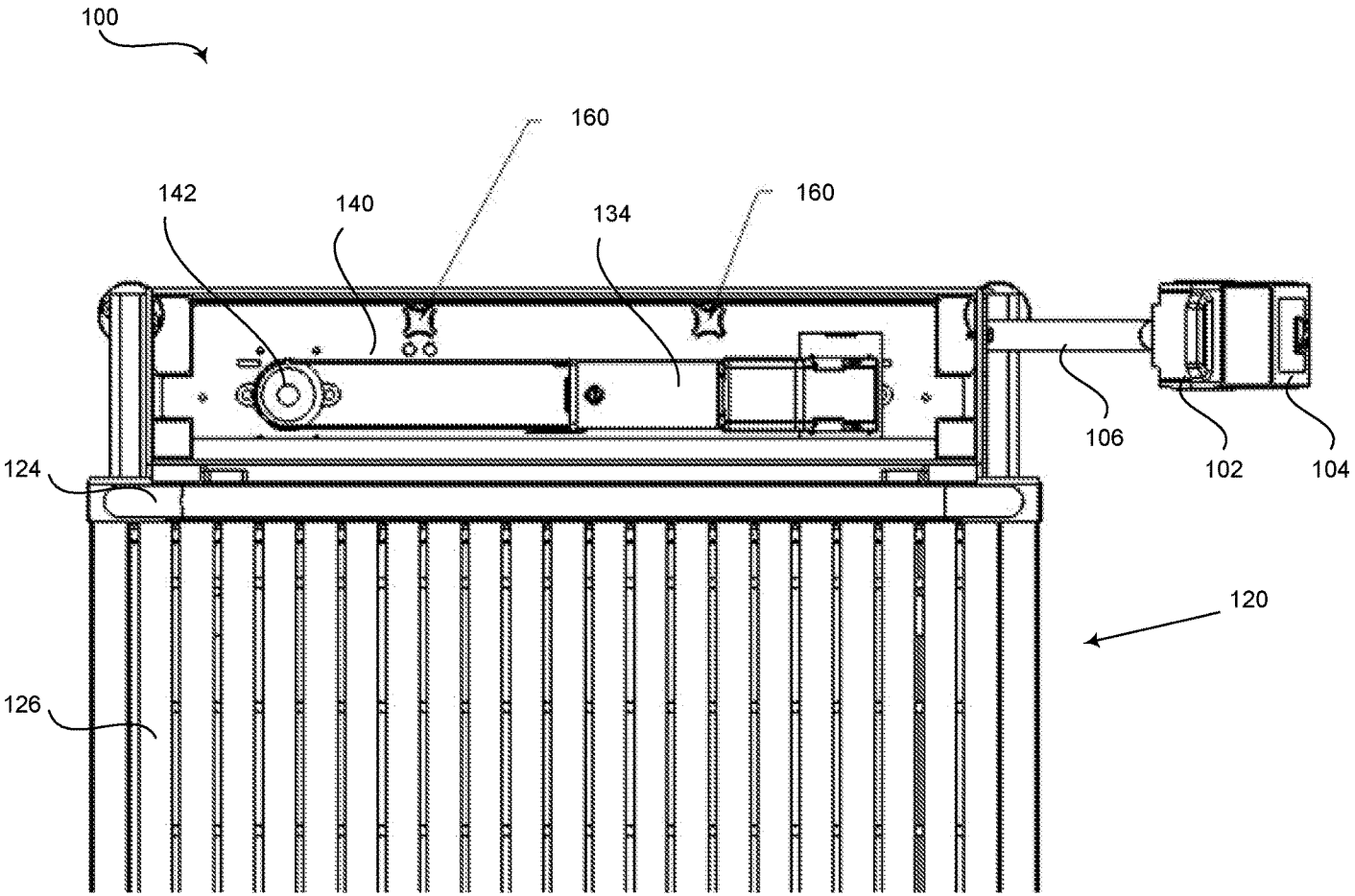
FIG. 6 is a top elevation view of an exemplary platform lift without a lifting component case top, in accordance with an embodiment of the invention.

In certain embodiments, a maximum elevated position height and/or a minimum lowered position height of the platform 120 may be adjustable. For example, a user may desire to adjust the platform lift 100 such that the maximum height may align the platform deck 126 with the pool deck and the minimum height can align the platform deck 126 with the pool floor. In an example embodiment, the maximum and minimum heights can be controlled by two electronic switches 166 adjusted by two stop adjustment knobs 160 located in the lifting component case 108. A user may access the stop adjustment knobs 160 by, for example, removing the case top 112. FIG. 6 is a top elevation view of an exemplary platform lift 100 without a lifting component case top 112, in accordance with an embodiment of the invention. Referring to FIG. 6, the stop adjustment knobs 160 can be rotated clockwise and counterclockwise to raise and lower the electronic switches 166 to set a maximum platform deck 126 height and a minimum platform deck 126 height.

Referring again to FIG. 4, each of the stop adjustment knobs 160 is attached to and rotates a rod 162. The rod 162 can be threaded such that it is attached to the electronic switch 166 by a coupling nut. The electronic switch 166 is movable within a slider guide 164, which defines a height adjustment range. As each of the stop adjustment knobs 160 is turned, the rod 162 is rotated such that the coupling nut attached to the electronic switch 166 is raised or lowered, depending on the turn direction of the knob, within the slider guide 164. The rod 162 can be fiberglass or any suitable material. The electronic switches 166 can be Hall effect sensors, or any suitable switch, that provides a signal to the control console 104 when the platform 120 reaches the minimum or maximum height so that the electric motor 134 can be switched off. For example, the carriage plate 146 can comprise one or more magnets and when the Hall effect sensors 166 detect the magnetic field emitted by the magnet(s) of the carriage plate 146, an output voltage of the Hall effect sensors 166 to the control console 104 can be varied to signal that the minimum or maximum height has been reached and the electric motor 134 is turned off.

Figure 8:
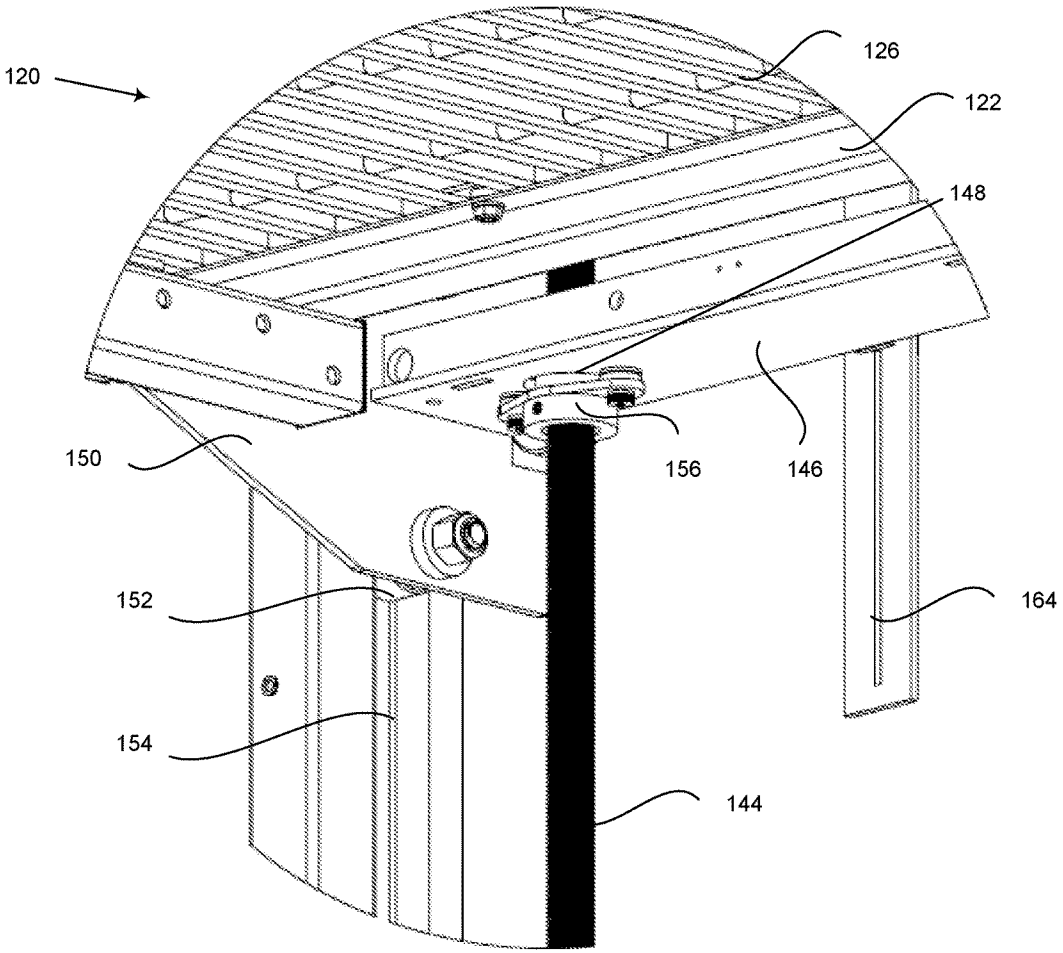
FIG. 8 is a front perspective view of a platform attached to lifting components of an exemplary platform lift, in accordance with an embodiment of the invention.

FIG. 8 is a front perspective view of a platform 120 attached to lifting components 144, 146, 150, 156 of an exemplary platform lift 100, in accordance with an embodiment of the invention. Referring to FIG. 8, a platform frame 122 that supports a platform deck 126 is coupled to carriage connector brackets 150 that extend from the ends of the carriage plate 146. The carriage plate 146 comprises carriage apertures 148. The power screws 144 extend through the carriage apertures 148 and are flexibly attached to the carriage plate 146 by the power screw receiving mechanisms 156. In an example embodiment, the power screw receiving mechanisms 156 are bearings and linear lead screw nuts that travel up and down the power screws 144 depending on the power screw rotation direction.

More specifically, washers can be used to attach the linear lead screw nuts 156 to the carriage plate 146 such that the linear lead screw nuts 156 extend through the carriage apertures 148 and are angularly aligned with and coupled to the power screws 144. The washers provide the linear lead screw nuts 156 with a flexible angular alignment to the power screws 144 to prevent binding at the connection of the linear lead screw nuts 156 to the power screws 144. A carrier is attached to each of the linear lead screw nuts 156 to prevent rotation of the linear lead screw nuts 156 as the power screws 144 are rotated. The carriage plate 146 travels up and down with the linear lead screw nuts 156 on the power screws 144 as the power screws 144 are turned by the electric motor 134.

In various embodiments, the power screws 144 can be stainless steel or any suitable material. The power screws 144 may not need a grease lubricant because the platform lift 100 is mounted in a pool and the power screws 144 can use pool water as the working lubricant. Still referring to FIG. 8, carriage wheels 152, which may be polymer plane bearings with stainless steel rollers, for example, can be attached to each carriage connector bracket 150 for slidably coupling with the wheel guide slots 154 in the lifting component case 108 to safely and evenly distribute the loads. In an example embodiment, each carriage connector bracket 150 may include three carriage wheels 152 for a total of six carriage wheels 152 in the platform lift 100.

Figure 9:
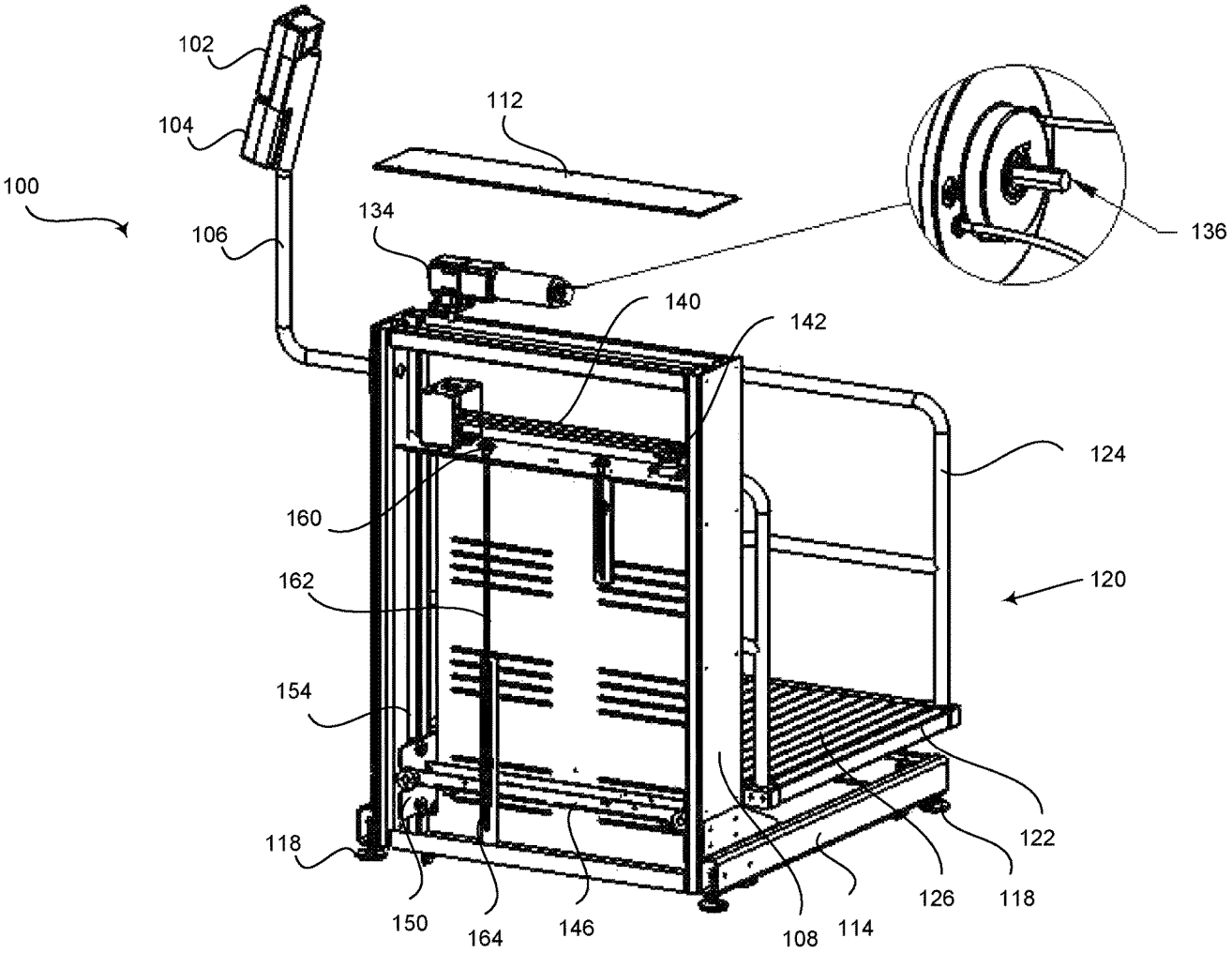
FIG. 9 is a partially exploded view of an emergency drive of an electric motor of an exemplary platform lift, in accordance with an embodiment of the invention.

FIG. 9 is a partially exploded view of an emergency drive 136 of an electric motor 134 of an exemplary platform lift 100, in accordance with an embodiment of the invention. Referring to FIG. 9, the electric motor 134 comprises an emergency drive 136. The emergency drive 136 can be manually driven to override the electrical power source 102 and/or control console 104 in the event of, for example, a malfunction or loss of power. For example, manually driving the emergency drive 136 of the electric motor 134 creates rotational energy of a motor shaft attached to a shaft of a sprocket 142 via a shaft coupler 138. The shaft coupler 138 transmits the torque generated by manually driving the emergency drive 136 to the sprocket 142, which rotates the power screw 144 and the belt 140. As the belt 140 is rotated, a second sprocket 142 attached to a second power screw 144 is rotated such that the power screws 144 are simultaneously rotated in a same direction to cooperate in elevating and lowering the platform 120.

Figure 10:
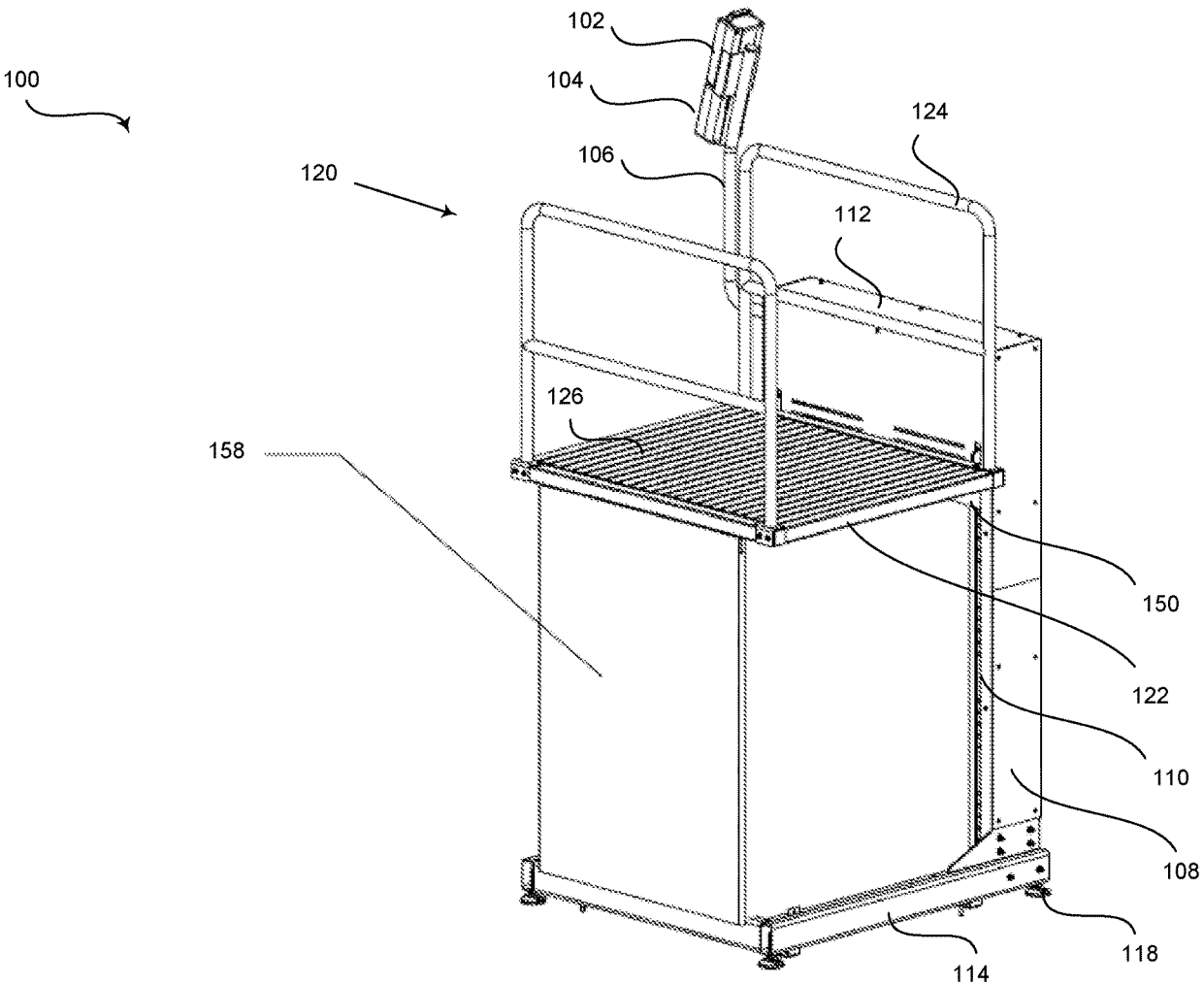
FIG. 10 is front perspective view of an exemplary platform lift with a screen and with the platform in an elevated position, in accordance with an embodiment of the invention.

FIG. 10 is front perspective view of an exemplary platform lift 100 with a screen 158 and with the platform 120 in an elevated position, in accordance with an embodiment of the invention. Referring to FIG. 10, the platform lift 100 comprises an electrical power source 102, a control console 104, a lifting component case 108, a lifting frame 114, and a platform 120. The electrical power source 102 provides power to the control console 104 and lifting components disposed in the lifting component case 108. The control console 104 provides control of the operation of the platform lift 100. The lifting frame 114 mounts to a pool floor and couples to the lifting component case 108 to hold the lifting component case 108 in an upright (i.e., vertical) position as described above in connection with FIG. 1. The platform 120 comprises a frame 122, rails 124, and a deck 126 as described above in connection with FIGS. 1-2. A screen 158 may be attached to the platform 120, for example, at the frame 122 or over the rails 124 such that no gaps for entrapment are provided between an elevated platform 120 and the lifting frame 114. The screen 158 collapses with the platform 120 as the platform 120 lowers to the lowered position. In various embodiments, the screen 158 may be a mesh net barrier or any suitable material.

In accordance with various embodiments of the invention, a system 100 for providing assisted access to a pool comprises a platform 120 that comprises a frame 122, a deck 126, and one or more handrails 124. The deck 126 is attached to the frame 122 and sized to receive a wheelchair. The one or more handrails 124 are attached to at least one of the frame 122 and the deck 126. The system 100 comprises an upright lifting component case 108. The frame 122 of the platform 120 is substantially perpendicular to the upright lifting component case 108. The system 100 comprises lifting components (e.g., 134, 138, 140, 142, 144, 146, 150, 156) that are at least partially disposed in the upright lifting component case 108 and attached to the platform 120. The lifting components (e.g., 134, 138, 140, 142, 144, 146, 150, 156) are operable to vertically move the frame 122 between a top and a bottom of the upright lifting component case 108. The system 100 comprises an electrical power source 102 operable to provide electrical power to at least a portion of the lifting components (e.g., 134).

In an example embodiment, the electrical power source 102 is a rechargeable battery. In various embodiments, the system 100 comprises a control console 104 configured to control the lifting components (e.g., 134, 138, 140, 142, 144, 146, 150, 156). In certain embodiments, the control console 104 comprises a radio frequency control receiver powered by the electrical power source 102. The radio frequency control receiver is configured to receive wireless control signals to control the lifting components (e.g., 134, 138, 140, 142, 144, 146, 150, 156).

In various embodiments, the system 100 comprises at least one wireless handset 168 operable to wirelessly transmit directional control signals to the radio frequency control receiver of the control console 104 in response to a user input 170 received at the at least one wireless handset 168. In an example embodiment, the at least one wireless handset 168 enters a sleep mode if a user input 170 is not received for a predetermined period of time. The at least one wireless handset 168 comprises a lockout mechanism 172 configured to awake the at least one wireless handset 168 from the sleep mode to enable receiving the user input 170.

In certain embodiments, the system 100 comprises a lifting frame 114 attached to the upright lifting component case 108. The lifting frame 114 is operable to support the upright lifting component case 108 in an upright position. The lifting frame 114 comprises hardware operable to level 118 the lifting frame 114 and mount 116 the lifting frame 114 to a pool floor. In various embodiments, the system 100 comprises a screen 158 attached to the platform 120 and extending to the lifting frame 114. The screen 158 is collapsible as the platform 120 is lowered from an elevated position to a lowered position. The screen 158 is operable to prevent solid objects from entering an area between the frame 122 of the platform 120 and the lifting frame 114. In an example embodiment, the deck 126 is fiberglass and comprises a non-slip textured surface. In certain embodiments, the frame 122 comprises a platform adjustment mechanism 128 operable to adjust an angle of the deck 126.

In an example embodiment, the lifting components (e.g., 134, 138, 140, 142, 144, 146, 150, 156) comprise a carriage 146, at least one power screw 144, at least one power screw receiving mechanism 156, and an electric motor 134. The carriage 146 is attached to the platform 120. The at least one power screw receiving mechanism 156 couples the carriage 146 to the at least one power screw 144. The electric motor 134 is powered by the electrical power source 102. The electric motor 134 is operable to generate torque that rotates the at least one power screw 144. The rotation of the at least one power screw 144 in a first direction causes the at least one power screw receiving mechanism 156 to travel up the at least one power screw 144 to elevate the platform 120. The rotation of the at least one power screw 144 in a second direction causes the at least one power screw receiving mechanism 156 to travel down the at least one power screw 144 to lower the platform 120.

In various embodiments, the carriage 146 is a plate that comprises carriage connector brackets 150 that attach to the frame 122 of the platform 120. In certain embodiments, the upright lifting component case 108 comprises slots 110. The carriage connector brackets 150 extend through the slots 110 to attach to the frame 122 of the platform 120. In an example embodiment, the at least one power screw 144 comprises two power screws. Each of the power screws 144 are attached to a sprocket 142. The sprockets 142 are coupled by a belt 140. The rotation of one of the two power screws 144 by the electric motor 134 causes the other of the two power screws 144 to simultaneously rotate in the same direction due to the sprockets 142 coupled by the belt 140. In various embodiments, the at least one power screw receiving mechanism 156 comprises a linear lead screw nut extending through 148 and attaching to the carriage 146. The linear lead screw nut 156 is flexibly and angularly aligned to the at least one power screw 144 to prevent binding at the coupling of the linear lead screw nut 156 and the at least one power screw 144.

In certain embodiments, the upright lifting component case 108 comprises wheel guide slots 154. The carriage connector brackets 150 comprise carriage wheels 152 that slidably couple with the wheel guide slots 154. In an example embodiment, the electric motor 134 comprises an emergency drive 136 that is drivable without power from the electrical power source 102.

In various embodiments, the system 100 comprises an electronic switch 166, a threaded rod 162, a slider guide 164, and a stop adjustment knob 160. The threaded rod 162 is attached to the electronic switch 166 by a coupling nut. The slider guide 164 defines a height adjustment range. The electronic switch 166 is movable within the slider guide 164. The stop adjustment knob 160 is attached to the threaded rod 162. The stop adjustment knob 160 is operable to rotate the threaded rod 162 to move the electronic switch 166 vertically within the slider guide 164. The electronic switch 166 sets one or more of a maximum elevated position height and a minimum lowered position height of the frame 122 of the platform 120. The rotation of the threaded rod 162 in a first direction causes the coupling nut attached to the electronic switch 166 to travel up the threaded rod 162 within the slider guide 164. The rotation of the threaded rod 162 in a second direction causes the coupling nut attached to the electronic switch 166 to travel down the threaded rod 162 within the slider guide 164.

In an example embodiment, the electronic switch 166 is a Hall effect sensor. In certain embodiments, one or more of the upright lifting component case 108 and at least a portion of the lifting components (e.g., 134, 138, 140, 142, 144, 146, 150, 156) is at least one of fiberglass and coated with a corrosion resistant barrier.

Although devices and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A system, comprising:

a platform comprising:

a frame, a deck attached to the frame and sized to receive a wheelchair, and at least one handrail attached to at least one of the frame and the deck;

an upright lifting component case, wherein the frame of the platform is substantially perpendicular to the upright lifting component case;

lifting components at least partially disposed in the upright lifting component case and attached to the platform, the lifting components operable to vertically move the frame between a top and a bottom of the upright lifting component case;

an electrical power source operable to provide electrical power to at least a portion of the lifting components;

a first electronic switch disposed within a first slider guide having a first elevational position in the upright lifting component case, the first electronic switch configured to move vertically within the first slider guide to set a maximum elevated position height of the frame of the platform, wherein the first slider guide at the first elevational position defines a first height adjustment range of the first electronic switch; and a second electronic switch disposed within a second slider guide having a second elevational position different than the first elevational position in the upright lifting component case, the second electronic switch configured to move vertically within the second slider guide to set a minimum lowered position height of the frame of the platform, wherein the second slider guide at the second elevational position defines a second height adjustment range of the second electronic switch.

2. The system according to claim 1, wherein the electrical power source is a rechargeable battery.

3. The system according to claim 1, wherein the deck is fiberglass and comprises a non-slip textured surface.

4. The system according to claim 1, wherein the frame comprises a platform adjustment mechanism operable to adjust an angle of the deck.

5. The system according to claim 1, comprising a threaded rod attached to the first electronic switch by a coupling nut; and wherein the threaded rod is rotatable to move the first electronic switch vertically within the first slider guide;

wherein rotation of the threaded rod in a first direction causes the coupling nut attached to the first electronic switch to travel up the threaded rod within the first slider guide; and wherein rotation of the threaded rod in a second direction causes the coupling nut attached to the first electronic switch to travel down the threaded rod within the first slider guide.

6. The system according to claim 1, wherein each of the first electronic switch and the second electronic switch is a Hall effect sensor.

7. The system according to claim 1, wherein at least one of:

the upright lifting component case, and at least a portion of the lifting components, is at least one of fiberglass and coated with a corrosion resistant barrier.

8. The system according to claim 1, comprising at least one adjustment knob configured to vertically move at least one of the first electronic switch and the second electronic switch to set at least one of the maximum elevated position height and the minimum lowered position height of the frame of the platform.

9. The system according to claim 1, comprising a lifting frame attached to the upright lifting component case, the lifting frame operable to support the upright lifting component case in an upright position, the lifting frame comprising hardware operable to level the lifting frame and mount the lifting frame to a pool floor.

10. The system according to claim 9, comprising a screen attached to the platform and extending to the lifting frame, wherein the screen is collapsible as the platform is lowered from an elevated position to a lowered position, and wherein the screen is operable to prevent solid objects from entering an area between the frame of the platform and the lifting frame.

11. The system according to claim 1, comprising a control console configured to control the lifting components.

12. The system according to claim 11, wherein the control console comprises a radio frequency control receiver powered by the electrical power source, the radio frequency control receiver configured to receive wireless control signals to control the lifting components.

13. The system according to claim 12, comprising at least one wireless handset operable to wirelessly transmit directional control signals to the radio frequency control receiver of the control console in response to a user input received at the at least one wireless handset.

14. The system according to claim 13, wherein the at least one wireless handset enters a sleep mode if a user input is not received for a predetermined period of time, and wherein the at least one wireless handset comprises a lockout mechanism configured to awake the at least one wireless handset from the sleep mode to enable receiving the user input.

15. The system according to claim 1, wherein the lifting components comprise:

a carriage attached to the platform, at least one power screw, at least one power screw receiving mechanism coupling the carriage to the at least one power screw, and an electric motor powered by the electrical power source, the electric motor operable to generate torque that rotates the at least one power screw, wherein rotation of the at least one power screw in a first direction causes the at least one power screw receiving mechanism to travel up the at least one power screw to elevate the platform, and wherein rotation of the at least one power screw in a second direction causes the at least one power screw receiving mechanism to travel down the at least one power screw to lower the platform.

16. The system according to claim 15, wherein the at least one power screw comprises two power screws, each of the power screws attached to a sprocket, wherein the sprockets are coupled by a belt, and wherein rotation of one of the two power screws by the electric motor causes the other of the two power screws to simultaneously rotate in the same direction due to the sprockets coupled by the belt.

17. The system according to claim 15, wherein the electric motor comprises an emergency drive that is drivable without power from the electrical power source.

18. The system according to claim 15, wherein the carriage is a plate that comprises carriage connector brackets that attach to the frame of the platform.

19. The system according to claim 18, wherein the upright lifting component case comprises slots, and wherein the carriage connector brackets extend through the slots to attach to the frame of the platform.

20. The system according to claim 18, wherein the at least one power screw receiving mechanism comprises a linear lead screw nut extending through and attaching to the carriage, wherein the linear lead screw nut is flexibly and angularly aligned to the at least one power screw to prevent binding at the coupling of the linear lead screw nut and the at least one power screw.

21. The system according to claim 18, wherein the upright lifting component case comprises wheel guide slots, and wherein the carriage connector brackets comprise carriage wheels that slidably couple with the wheel guide slots.

* * * * *